US005590779A

United States Patent [19]

Ramsey

[11] Patent Number: 5,590,779

[45] Date of Patent: Jan. 7, 1997

[54] PRTOTECTIVE PACKAGING FOR VALUABLE ARTICLES

[76] Inventor: John L. Ramsey, 22407 78TH Ave. SE., Woodinville, Wash. 98072

[21] Appl. No.: 315,832

[22] Filed: Sep. 30, 1994

[51] Int. Cl.[6] ..... B65D 85/00

[52] U.S. Cl. ..... 206/459.1; 206/6.1; 206/769; 206/497

[58] Field of Search ..... 206/6.1, 45.31, 206/459.1, 459.5, 566, 44.11, 497, 769

[56] References Cited

U.S. PATENT DOCUMENTS

| | | | |
|---|---|---|---|
| 1,059,561 | 4/1913 | Parks | 206/44.11 |
| 1,639,750 | 8/1927 | Portman | 206/44.11 |
| 2,415,117 | 2/1947 | Tamarin | 206/247 |
| 3,424,367 | 1/1969 | Desmond | 206/45.31 |
| 3,528,598 | 9/1970 | Lock | 206/45.31 |
| 3,918,584 | 11/1975 | Richardson | 206/497 |
| 4,320,831 | 3/1982 | Szabo et al. | 206/45.34 |
| 4,516,679 | 5/1985 | Simpson et al. | 206/459.1 |
| 4,972,953 | 11/1990 | Friedman et al. | 206/459.1 |
| 5,011,005 | 4/1991 | Boyd et al. | 206/0.81 |
| 5,033,774 | 7/1991 | Benardelli | 283/108 |
| 5,064,664 | 11/1991 | Hustad | 206/459.1 |
| 5,067,612 | 11/1991 | Tsuchiya | 206/497 |
| 5,082,702 | 1/1992 | Alband | 206/459.5 |
| 5,143,218 | 9/1992 | Brauckmann | 206/467 |
| 5,201,463 | 4/1993 | George | 229/203 |
| 5,409,105 | 4/1995 | Appelbaum et al. | 206/45.19 |

*Primary Examiner*—David T. Fidei
*Attorney, Agent, or Firm*—Dowrey & Associates

[57] ABSTRACT

A tamper-evident packaging system for shipping and viewing valuable items. A two component rigid plastic container provides a cavity for containing the item and a filler material with a transparent area in the container wall for viewing the item. A tamper-evident thin-film tape is wrapped about the container to hold the container components together and a shrink wrap plastic coating is applied to the container and tamper-evident tape to enhance the tamper-evident function of the tape.

7 Claims, 1 Drawing Sheet

FIG. 1
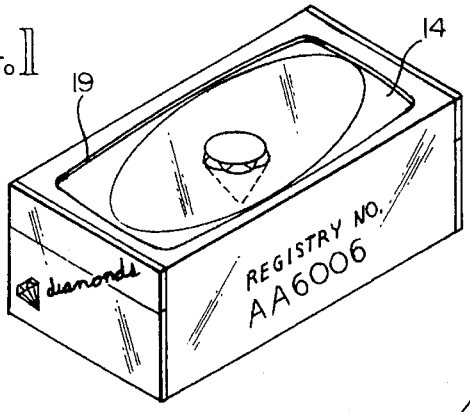
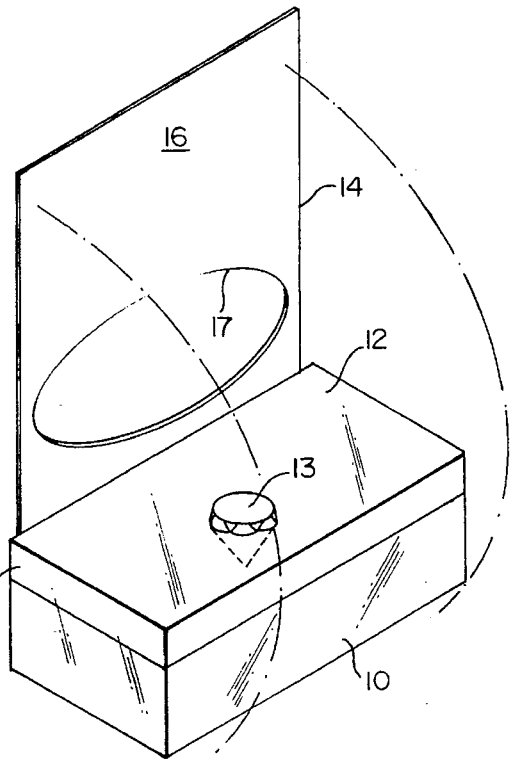
FIG. 2
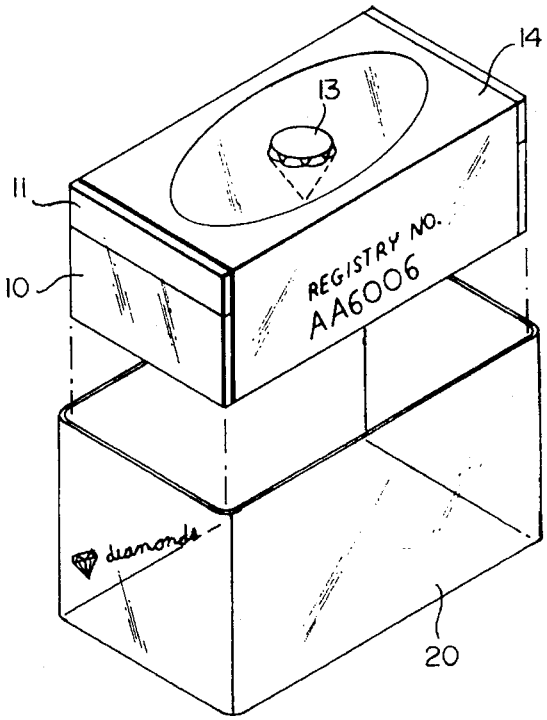
FIG. 3
FIG. 4
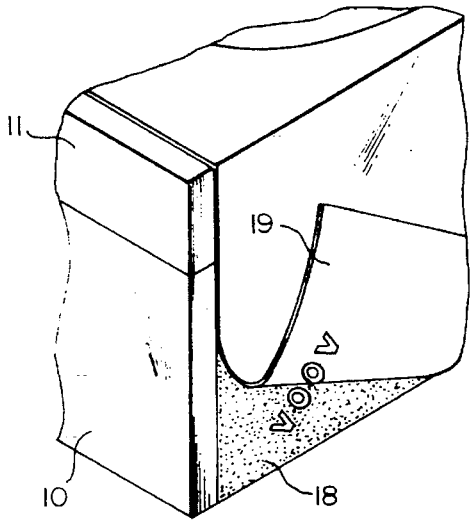

PRTOTECTIVE PACKAGING FOR VALUABLE ARTICLES

BACKGROUND OF THE INVENTION

1. Field of the Invention

The present invention relates to the packaging of valuable items such as gemstones, pearls or other rare and valuable items for the purpose of display and shipping. The purpose of the protective packaging is to provide a sturdy container or receptacle for shipping individual items of the character described while permitting the gemstone or the like to be viewed without opening the container and to further provide evidence of tampering or opening of the container for unauthorized purposes. The present invention has particular applicability for instance with regard to television marketing of such items as gemstones which are direct shipped to the purchaser after viewing on a TV screen with the condition that the item is not returnable once the packaging has been broken. As can be appreciated, the purchaser desires to view the actual precious stone before purchase is final and is usually given the opportunity of returning the item, provided the packaging has not been broken. Incidents of fraud have become an increasing concern in this type of marketing. The usual tampering method is to open the package, replace the precious item with a counterfeit replica and then return the package containing the worthless item to the marketing source.

2. Description of the Prior Art

Prior art containers have been developed for storing and displaying precious items such as gems, coins, medals, stamps and the like. The packaging permits the item to be viewed for grading or other purposes but provides for either tamper prevention or tamper evidencing to protect the authenticity of the item. U.S. Pat. No. 5,033,774 to Benardelli utilizes a plastic viewing case for a coin or precious stone with a delaminable hologram bonded between the elements of the container which becomes visibly and irreparably lacerated upon an opening attempt. U.S. Pat. No. 5,011,005 to Boyd et al likewise utilizes a tamper-evident device such as a thin-film tape or other optically variable coating which is disrupted or destroyed when surfaces in contact with either side of the tape are separated. The tape is used at points where an outer covering engages an inner element upon initial insertion of the inner element. The tamper-evident tape will irreversibly indicate separation of attached components as might occur in an attempt to gain access to the valuable item contained in the holder. U.S. Pat. No. 5,143,218 to Brauckmann is an example of an adhesive label which serves as a tamper-proof closure for a package or box of a generic kind.

U.S. Pat. No. 4,320,831 to Szabo et al discloses another form of protective packaging for displaying precious gems, coins or other small valuable articles wherein elements of the container may be fused together to prevent tampering in the course of transit. The problems encountered with tamper-evident films or tapes is that, under certain conditions of application of heat, the tamper-evident feature becomes permanently non-functional. In the case of fused portions of the container, it may be possible to break the seal and re-fuse the elements once a fraudulent substitution has been made.

U.S. Pat. No. 5,067,612 to Tsuchiya et al and U.S. Pat. No. 5,201,463 to George are cited as of interest for the showing of shrink wrap packaging not necessarily intended as tamper-evident closures. Because of their fragile nature and sensitivity to temperature extremes, this type of packaging has definite limitations and will not usually be guaranteed by the provider to remain intact for purposes such as the shipment of valuable gemstones and the like.

SUMMARY OF THE INVENTION

The present invention provides a tamper-evident packaging structure which enables a precious stone or the like to be contained in a transparent plastic container for shipment and viewing with enhanced tamper evidencing features which ensure the detection of fraudulent attempts to substitute counterfeit items for those originally packaged. The present invention combines the use of tamper-evident thin-film tape in a novel manner with a shrink wrap element such that each of these expedients serves to remedy deficiencies in the reliability of the other as tamper-evident vehicles. The thin-film tape of the type under consideration may be rendered non-functional upon exposure to certain elevated temperatures. These elevated temperatures will, however, serve to destroy the shrink wrap layer thus providing an indicator that an attempt has been made to tamper with the container closure. The shrink wrap layer, on the other hand, because of its instability and sensitivity to temperature extremes, is not sufficiently reliable in and of itself as a tamper-evident element. The shrink wrap layer thus enhances the function of the thin-film tape and vice-versa. According to the present invention, the thin-film tape may be any one of a number of commercially available tamper-evident products such as a top coated polyester film bottom coated with an aggressive pressure sensitive acrylic adhesive. The shrink wrap material may be made from any one of several known shrink wrap films such as polyethylene, polypropylene or polyvinyl chloride.

BRIEF DESCRIPTION OF THE DRAWINGS

FIG. 1 is a perspective view of a precious gem container with the packaging components applied;

FIG. 2 is a perspective view illustrating the manner of application of a tamper-evident thin-film tape;

FIG. 3 is a view of the container with the thin-film tape in place during the application of the shrink wrap layer; and FIG. 4 is detail view illustrating the removal of the tamper-evident thin-film tape leaving a pattern on the surface of the container.

DETAILED DESCRIPTION OF THE PREFERRED EMBODIMENT

The shipping and display container of the present invention may take any configuration or shape but should preferably be of at least a two-component construction with the components of the container interfitting to form a complete enclosure with a cavity therebetween. According to the present embodiment, a two-component rectangular cross section container is composed of a lower container body section 10 and a tightly interfitting lid 11 forming a cavity therebetween. The two halves of the container in the present embodiment are constructed from a clear plastic material and may be held together simply by a snug fit or, in the alternative, may include any form of snap lock or the like to hold the lid 11 in place on the body 10. The lid 11 could also be attached to the body portion by such means as conventional or snap hinging. Since the object of the container is two fold, namely to provide a sturdy package vehicle for shipping and a clear panel for viewing the contained gem stone, the material of the container should preferably be made of a rigid plastic material and should have at least one transparent wall or wall area covering the gem stone. In the present embodiment, the entire container, i.e. the lid and the body, are composed of transparent plastic material but, as a minimum, the top panel 12 of the lid 11 should be transparent.

The manner in which the gemstone 13 is suspended within the container may vary. In the present embodiment, the interior of the container is provided with a support substance such as a soft foam plastic or foam rubber filler. The gem stone 12 is simply set in the surface of the foam and the lid 11 then applied to hold the gem stone in place, viewable through the panel 12 of the lid. In this manner, the gem stone is suspended in the body of the protective foam substance and held in place by the snugly fitting lid.

The lid 11 is initially bound in place on the container body by means of a thin-film tape 14 as illustrated in FIG. 2. The tape 14 provides both a means for securing the components of the container together and as a tamper-evident member. The tape 14 is applied to the container surface by means of an aggressive adhesive on surface 16 and preferably engages at least three of the side surfaces of the assembled container. The fourth side of the container may also be contacted if desirable in a wrap-around manner as illustrated in FIG. 2. The tape 14 is provided with an opening 17 which, when the tape is applied to the container surface allows viewing of the gem stone 13 inside the box. The film 14 may be provided with decorative printing or the like and may be used as a surface to record the registry number of the gem stone as illustrated. The tamper-evident film tape 14 may be of any well known commercially available type which is normally a compound or multi-layered structure one layer of which delaminates and fractures upon removal, leaving a tell-tale pattern on the substrate to which it has been applied. One such tape is sold under the name TAMPERmark, a trademark of the FLEXcon Company, Inc, Spencer, Mass. This tape is comprised of a metalized polyester film layer 18, as illustrated in FIG. 4, which has been coated with an aggressive pressure sensitive acrylic adhesive which adheres to the surface of a substrate, such as the container body and lid surface in the present application. The polyester film is backed with a transparent release layer 19. The polyester film is provided with a pattern, in this case the word "VOID," which is adhesively connected to the backing on one side and releasable from the substrate. Once the composite film is adhered to the substrate, any attempt to remove the backing 19 results in delaminating and fracturing of the patterned area of the polyester film leaving a "VOID" pattern on the substrate surface.

The type of tamper-evident film described, however, has its limitations. Testing has shown that the tamper-evident feature of the particular film tape described becomes permanently non-functional after exposure to a temperature above 104° F. (40° C.). The tamper-evident feature is only functional between a range of –40° F. to 104° F. (–40° C. to 40° C.). The result is that a slow heating of the film wrapper allows the film to be removed without delamination and fracturing, thus leaving no trace of tampering.

According to the present invention, the tamper-evident feature of the thin-film wrapper is protected by means of a shrink wrap plastic outer coating. As illustrated in FIG. 3, once the thin-film tape 14 has been applied, the sealed container is covered with a shrink wrap plastic layer 20. The shrink wrap layer 20 may be of any well known clear, transparent plastic heat-shrinkable film. The plastic material of the shrink wrap layer is typically polyethylene, polypropelene or polyvinyl chloride. The patents to Tsuchiya et al U.S. Pat. No. 5,067,612 and George U.S. Pat. No. 5,201,463 disclose typical shrink wrap packaging materials and methods well known in the art. This type of wrapping is usually accomplished by passing the tubular shrink wrap material over the container and exposing it to heat which results in the shrinking of the plastic leaving exposed areas on the surface of the container bottom wall and top wall 16 as shown in FIG. 1. The exposed area left by the shrink wrap is made to coincide with the opening 17 in the thin-film tape so as not to interfere with viewing the gem stone. If desired, the shrink wrap layer 20 may be provided with printed advertising or other information as illustrated in the drawings. The gauge or thickness of the shrink wrap film will be chosen so as to provide a durable tight-fitting cover for the container. In the event an attempt is made to heat the wrapping tape 14 to obviate the tamper-evident feature of the tape, the shrink wrap film will be destroyed in the process, producing further positive evidence of tampering.

With the presence of the shrink wrap film in combination with the tamper-evident tape, it becomes impossible to open the container for any purpose without leaving positive evidence of tampering. The presence of the shrink wrap film thus enhances the function of tamper evidencing tape in a manner heretofore unknown.

The present invention has been described with respect to a preferred embodiment thereof and it will be realized that other embodiments are possible. For example, the shape, size and type of material from which the container body and lid 12 are constructed may be widely varied without departing from the spirit of the invention. Likewise the particular shrink wrap plastic utilized as well as the method of application may be varied without departing from the spirit of the invention. The tamper-evident thin-film tape disclosed may also be substituted with any equivalent tamper-evident tape which performs the functions described or their equivalents. Thus, it will be understood by those of ordinary skill in the art that variations and modifications can be effected within the scope and spirit of the invention.

What is claimed is:

1. A tamper-evident packaging for a valuable article comprising in combination;

a multi-part rectangular cross section parallelepipeid container constructed from rigid plastic and having at least one transparent wall for viewing the article, tamper-evident tape connecting the parts of said container and adhesively bonded to the outer surfaces thereof, said tamper-evident tape including an opening in the area of said transparent wall for viewing the article, a shrink wrap plastic layer heat shrunk into superimposed relation on said container and overlaying said tamper-evident tape, said shrink warp layer being seamless and covering portions of all sides thereof, and a compressible filler material within said container for holding said article in place adjacent said transparent wall.

2. A shipping and display container for housing and protecting at least one valuable article comprising in combination;

a container having at least two interfitting container components when assembled forming a cavity therebetween for housing at least one said valuable article, at least one of said container components including a transparent wall for viewing said article housed within said cavity, a compressible filler material within said cavity for holding said article in place adjacent said transparent wall, tamper-evident tape extending between said container components and adhesively bonded to the outside surfaces thereof for sealing said components in assembled condition to form said cavity, said tamper-evident tape including an opening in the area of said transparent wall for viewing the article, and a shrink wrap plastic film heat shrunk into superimposed relation on said assembled container in contact with substantial areas of the surface of said tamper-evident tape and covering portions of all sides thereof.

3. A shipping and display container for housing and protecting at least one valuable article comprising in combination;

a container having at least two interfitting container components when assembled forming a cavity therebetween for housing at least one said valuable article, said container components comprising a rectangular cross section parallelepiped constructed from rigid plastic, at least one of said container components including a transparent wall for viewing said article housed within said cavity a compressible filler material within said cavity for holding said article in place adjacent said transparent wall, tamper-evident tape extending between said components and adhesively bonded to the outside surfaces thereof for sealing said components in assembled condition to form said cavity, said tamper-evident tape including an opening in the area of said transparent wall for viewing the article, and a seamless shrink wrap plastic film heat shrunk into superimposed relation on said assembled container in contact with substantial areas of the surface of said tamper-evident tape and covering portions of all sides thereof.

4. A tamper-evident packaging according to claim 1 wherein the tamper-evident features of said tape becomes non-functioning by application of heat to said tape.

5. A tamper-evident packaging according to claim 4 wherein said tamper-evident feature becomes non-functional when the tape is heated above 104° F.

6. A tamper-evident packaging according to claim 5 wherein said tape comprises laminated thin-films and delaminates upon attempted removal leaving portions of one laminate on the surface of the container, evidencing tampering.

7. A tamper-evident packaging for a valuable article comprising in combination;

a multi-part container having at least one transparent wall for viewing the article, tamper-evident tape connecting the parts of said container and adhesively bonded to the outer surfaces thereof, said tamper-evident tape including an opening in the area of said transparent wall for viewing the article, a shrink wrap plastic layer heat shrunk into superimposed relation on said container and overlying said tamper-evident tape, said shrink wrap layer covering portions of all sides thereof, and a compressible filler material within said container for holding said article in place adjacent said transparent wall.

* * * * *

UNITED STATES PATENT AND TRADEMARK OFFICE

CERTIFICATE OF CORRECTION

PATENT NO. : 5,590,779

DATED : January 7, 1997

INVENTOR(S) : John L. Ramsey

It is certified that error appears in the above-identified patent and that said Letters Patent are hereby corrected as shown below:

Correct the title to read:

PROTECTIVE PACKAGING FOR VALUABLE ARTICLES

Signed and Sealed this

Eighth Day of April, 1997

Bruce Lehman

*Attest:*

BRUCE LEHMAN

*Attesting Officer*

*Commissioner of Patents and Trademarks*